United States Patent [19]

Hörtig

[11] 3,951,083

[45] Apr. 20, 1976

[54] DEVICE FOR FORMING A SMOOTH, I.E. IN PARTICULAR A CREASE- AND UNDULATION-FREE INWARDS CONVEX FLANGE-BEARING EDGE-GROOVE OR -CORRUGATION ONTO THE OPEN END OF A METAL HOLLOW BODY OR CONTAINER FORMED IN A PRESS

[75] Inventor: Wilhelm Hörtig, Auerbach, Germany

[73] Assignee: KM-Engineering AG, Basel, Switzerland

[22] Filed: Nov. 21, 1974

[21] Appl. No.: 525,782

[30] Foreign Application Priority Data

Nov. 21, 1973 Switzerland ..... 16367/73

[52] U.S. Cl. ..... 113/7 A; 72/348; 72/402; 72/465; 113/120 AA

[51] Int. Cl.[2] ..... B21D 51/26

[58] Field of Search .... 113/120 H, 120 AA, 120 M, 113/1 G, 7 R, 7 A; 72/355, 396, 402, 398, 465, 348

[56] References Cited

UNITED STATES PATENTS

| | | | |
|---|---|---|---|
| 3,260,089 | 7/1966 | Hazelton et al. | 72/117 |
| 3,415,105 | 12/1968 | Brown et al. | 72/402 |
| 3,687,098 | 8/1972 | Maytag | 113/120 R |
| 3,698,337 | 10/1972 | Brawner et al. | 113/120 AA |
| 3,807,209 | 4/1974 | Aschberger et al. | 113/120 M X |

*Primary Examiner*—Victor A. DiPalma
*Attorney, Agent, or Firm*—John C. Smith, Jr.

[57] ABSTRACT

A reciprocally driven device is provided for forming a smooth inwardly convex flange-bearing edge-groove or -corrugation onto the open end of a metal container. A punch is moved axially to secure the container in a receiver, to move at least two cheeks towards the axis of the punch and to compress a resilient pressure-cushion about the periphery of the punch to form the flange-bearing edge-groove in the open end of the container. The device is particularly useful on an extrusion press which forms the drawn metal hollow body of the container.

16 Claims, 15 Drawing Figures

39a
39
38
79
37
78
75
40
35
76
77
71
70
68
18
56
62
59a
63
59
36b
23
36
36a
51
54
40
53
35a
64
69
29
65
74
72
58a
57
52
73
55
60
61
58
59b

Fig. 10
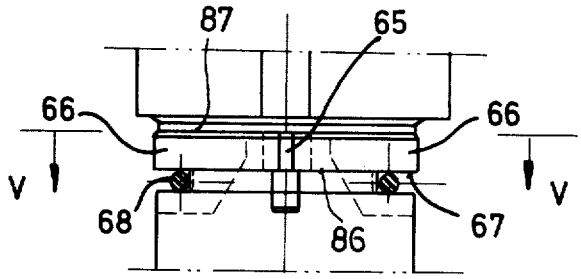
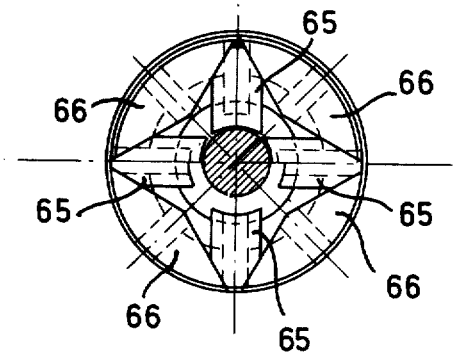
Fig. 11

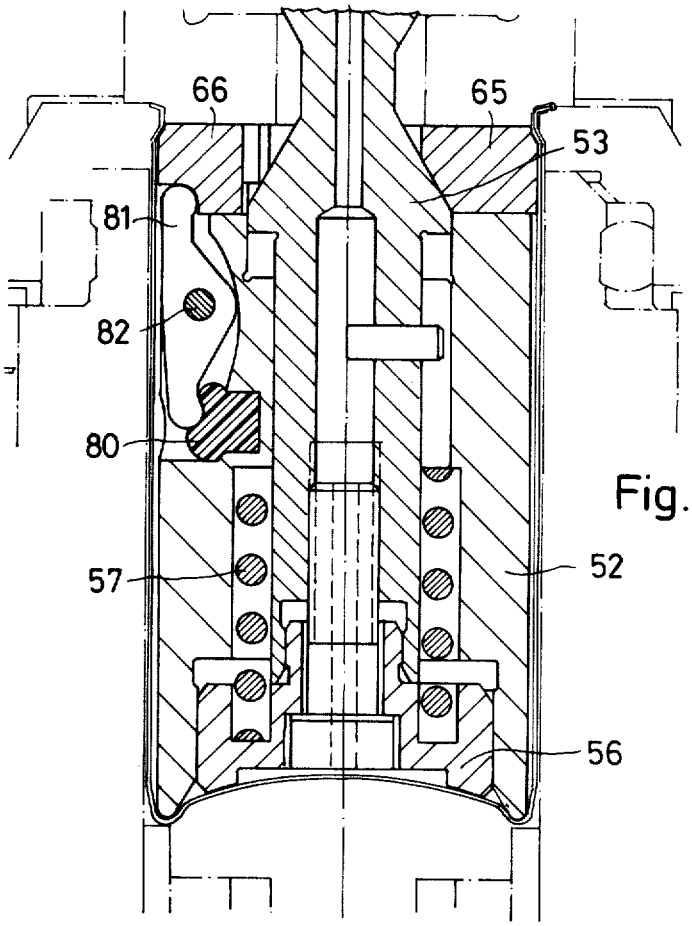
Fig. 12
Fig. 13
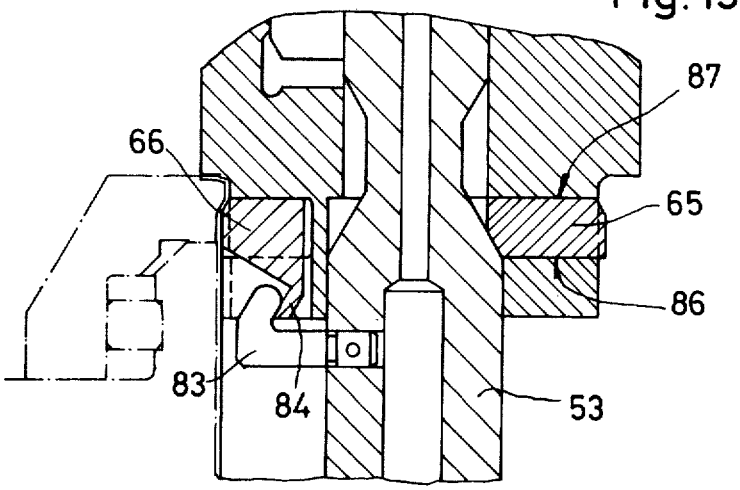

DEVICE FOR FORMING A SMOOTH, I.E. IN PARTICULAR A CREASE- AND UNDULATION-FREE INWARDS CONVEX FLANGE-BEARING EDGE-GROOVE OR -CORRUGATION ONTO THE OPEN END OF A METAL HOLLOW BODY OR CONTAINER FORMED IN A PRESS

The present invention relates to a device for forming a smooth, i.e., in particular a crease- and undulation-free, inwardly convex flange-bearing edge-groove or -corrugation onto the open end of a metal hollow body formed in a press.

It is well known that metal can bodies are provided in the edge zone (the zone at the open end) with a groove running round it peripherally and bearing a flange, which is used, for example, for securing a cover by folding. For forming the groove at least one separate machine was hitherto needed. The can body to be grooved was in that case pushed onto a mandrel and then the groove was formed in it by pressure from a roller. Quite apart from the disadvantage that with this method at least one separate machine is necessary just for forming the groove, there is needed for feeding the can body, pushing it onto the mandrel, pressing it and stripping it off the mandrel again, a relatively large expenditure of time, so that the method is not very economical. The installation of a second machine involves additional automatic feeds and buffer-zones lying between the machines, so that this known method must be regarded as unfavourable from the point of view of concatenation and space occupied.

A combination of this working step for forming an edge-groove with the known methods of production was hitherto not possible.

It is therefore the object of the present invention to propose for forming a crease- and undulation-free edge-groove onto the open end of a drawn metal hollow body on an extrusion press a device which can be accommodated and actuated on the press used for production of the hollow-body and moreover guarantees also at high stroke rates distortionless smooth groove-surfaces.

The device forming the object of the invention is accordingly characterized by

— a tool top-part arranged to be reciprocally driven periodically, in which a punch is supported to be able to slide axially towards at least one resiliently prestressed deflector-member, a receiver for receiving the metal container to be shaped and provided with a corresponding bore, at least two cheeks arranged in the zone of the mouth of the receiver bore, the working surfaces of which face the axis of the punch and bear the profile of the groove to be formed in the edge of the hollow body and which are slidable in the radial direction on a sliding surface on the face of the receiver, at least one shaping-part which is arranged at the periphery of the punch between a part of the punch and pressure-transfer member arranged in the punch housing, as well as a holddown supported slidingly above the bottom part of the tool and arranged coaxial with the punch and which bears by its top face via a prestressed force-transfer members against the toolpart, whereby the cheeks respectively the shaping parts during the working stroke of the punch get pressed from the outside respectively the inside against the top edge of the hollow-body and shape the edge-groove or -corrugation, the pressure-transfer member performing a relative movement with respect to the punch during the pressing against of the cheeks or the shaping-parts.

This device which for its drive requires merely a recipiocal ram or punch motion can be combined with a press used for non-cutting production of metal hollow bodies, in particular a multistage press.

In a special embodiment it is provided that the receiver is supported coaxial with the punch to be able to slide axially against the prestress of at least one recall-member, that the cheeks are anchored in the receiver and on their sides remote from the axis of the punch are guided along inclined guideways in such a way that any axial motion of the receiver also compels radial displacement of the cheeks, and that the shaping-part is a resiliently deformable pressure-cushion which is arranged at the periphery of the punch between a shoulder on the punch and a pressure-transfer member fixed rigidly in the punch housing, the force of prestress of the deflector-member acting on the punch as well as those of the force-transfer members of the holddown being respectively at least equal to the sum of the forces acting on the ejector and the receiver so that during a downward movement of the punch housing the holddown encounters the receiver and/or the cheeks and with simultaneous axial displacement of the receiver presses the cheeks radially inwards against the container-edge to be shaped, whereupon the pressure-transfer member encounters the resilient pressure-cushion and presses this at least against the bottom section of the profile of the considered and partially preformed groove.

It may further be provided that the prestressed deflector-member is for the purpose of achieving a space-saving arrangement a wedge supported in the tool top-part to be able to slide transversely to the axis of the punch and the oblique face of which rests against a correspondingly formed oblique face on the punch and the side of which opposite to the oblique face is supported by a support-member which is under prestress.

Embodiments of the device in accordance with the invention are illustrated in the attached drawing.

FIGS. 10 and 11 show details of construction;

FIG. 12 shows by means of a vertical section one variant upon the resilient recall of the bottom parts of the die;

FIG. 13 illustrates likewise in the form of a vertical section one possibility of rigid recall of the bottom parts of the die.

Figure 1:
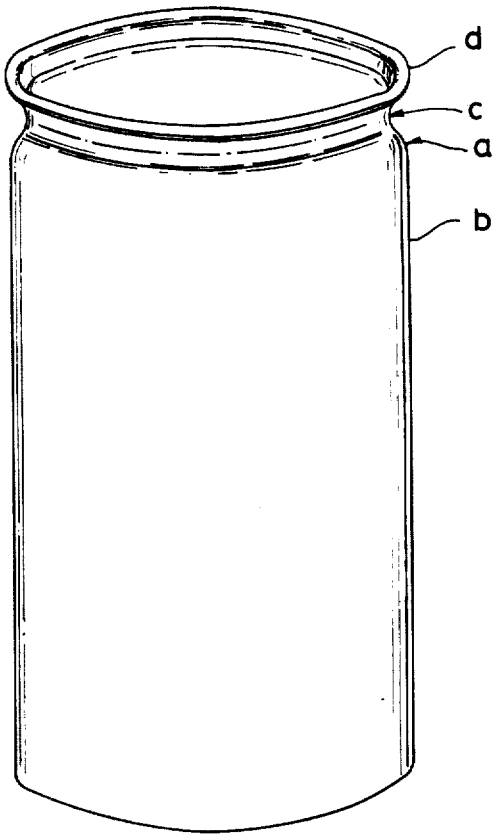
FIG. 1 is a three-dimensional view.
Figure 2:
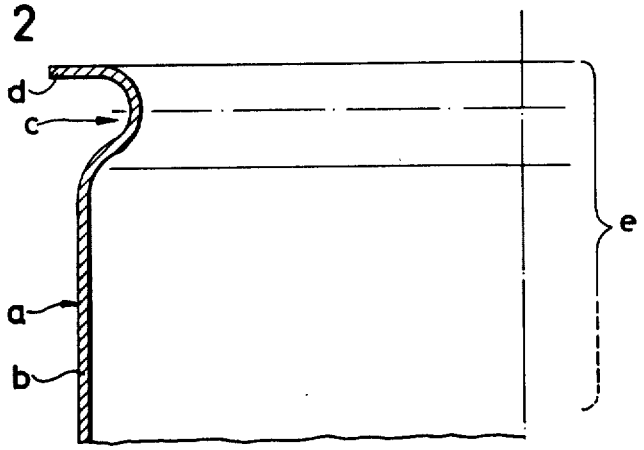
FIG. 2 is a detail of a can body provided with an edge-groove and a flange, the flange in this case forming a component of the edge-groove.

The three-dimensional view as in FIG. 1 as well as the detail in FIG. 2 show a can body *a* with a circular cylindrical wall *b*. In the edge zone designated by *e* the can body exhibits at its open end an edge-groove *c* the outer part of which is a flange *d* which permits a can cover (not shown) to be secured by folding.

The device illustrated in FIGS. 3 to 6 is used for achieving an edge-groove *c* like this, provided with a flange *d*. It exhibits a tool top-part 1 which is fixed by means of a holding device 2 to a chuck 3 which is driven reciprocally. A washer 4 is used for coarse height-adjustment.

In a central stepped bore 5 in the tool top-part is supported a punch 6 the top part of which is provided with grooves 7 and channels 8 for lubricant and exhibits for the purpose of achieving a spacesaving arrangement an axial wedge, i.e. a wedge **6*d* movable in the axial direction by an oblique face 9 inclined at 30° to the horizontal. This oblique face 9 cooperates with an oblique face 10 of equal inclination on a radial wedge 11. The radial wedge 11 is square in cross-section and is likewise provided with grooves 12 and channels 13 for lubricant and is supported to slide in a transverse opening 14 machined out of the tool top-part; it is forced against the oblique face of the axial wedge 6*d* by a stud 15 which is acted upon by a spring stack 16**.

Figure 3:
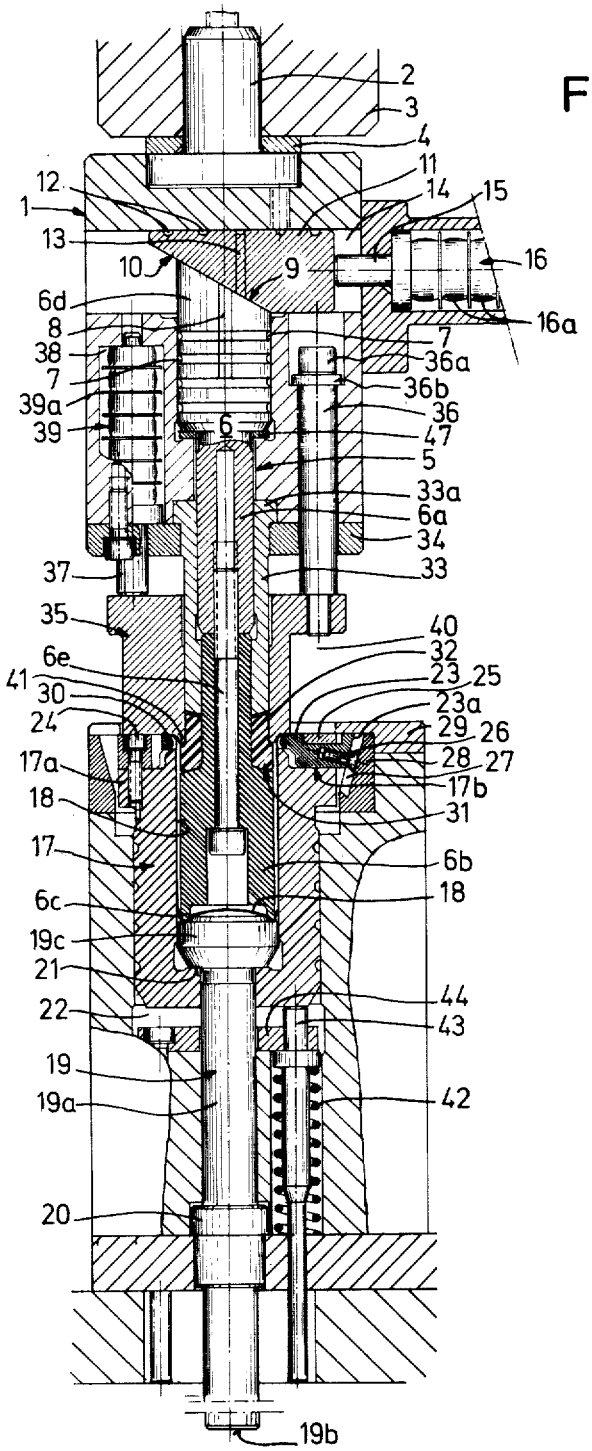
FIG. 3 is a simplified vertical section of such a device, parts inessential to comprehension of the basic idea of the invention having been omitted.

In the position of the wedge-drive shown in FIG. 3 the spring stack 16 composed of individual spring elements (e.g., resilient plastics rings) is under its normal pre-stress. Any shift of the radial wedge 11 in the direction of the stud 15 effects an increase in the restoring force applied by a spring, with the tendency to force the radial wedge 11 back again into the original position as in FIG. 3.

The two-part punch 6 consisting of top-part **6*a* and a bottom-part 6*b* which are held together by a bolt 6*e*, projects by its bottom-part 6*b* into a bore in a receiver 17 in which lies a can body 18 which is to be shaped. The end of the can body 18 is held by the annular shoulder-shaped tip 6*c* of the punch against the face of an ejector-head 19*c*. The ejector-rod 19*a* guided in a guide-bush 20 is at its face designated by 19*b* under the influence, for example, of a resilient medium such as compressed air. The head 19*c* of the ejector 19 projects into the bore in the receiver 17 and seats against the annular-shoulder-shaped stop 21**.

The receiver 17 which is supported to slide in a bore 22 in the bottom-part of the tool is formed as a practically circular cylindrical bush which exhibits at its top part a radial flange **17*a*. A return-rod 43 loaded by a spring 42 keeps the receiver in the event that no opposingly acting forces arise, in the upper position as in FIG. 3. The lower end position of the receiver 17 is given by a stationary stop-plate 44**.

On the annular sliding surface **17*b* on the face of the flange 17*a* four cheeks 23 are anchored by a holder-ring 25 fixed by means of bolts 24 so that the cheeks can be shifted to a limited degree across the facial sliding surface 17*b* radially towards the axis of the punch and away from it. In addition the cheeks are provided at the side of them remote from the axis of the punch each with a recall-element 26 which projects by its head into an inclined dovetail groove 27. Thanks to this guidance it is brought about that upon return of the receiver 17 into its rest position the four cheeks 23** are drawn back.

The dovetail grooves 27 are applied to the inner surface of a guidering 28 which fits in the bottom-part of the tool and is retained by a coverplate 29. The coverplate 29 is in turn fixed by bolts **29*a* (FIG. 4) onto the bottom-part of the tool. It serves at the same time to limit the axial movement of the receiver upwards. The working surfaces 30 of the four cheeks 23** next to the punch complete one another mutually into the annular profile to be applied to the edge of the can.

On an oblique shoulder 31 on the bottom-part **6*b* of the punch a pressure-cushion 32 consisting of a resiliently compressible mass is arranged which surrounds the punch in the form of a ring and is connected at its top face with a pressure-transfer bush 33 fixed in the punch housing 1. The pressure-transfer bush 33 is supported to slide on the periphery of the punch and is clamped by means of its flange 33*a* between the top-part 1 of the tool and its bottom retainer-plate 34**.

On the periphery of the pressure-transfer bush 33 a holddown 35 is arranged, the movement of which in the tool top-part is limited in the axial direction by means of spacer-sleeves 36 and clampscrews **36*a* with washers 36*b* and which in addition is acted upon by prestressed thrust-bolts 37. The symmetrically arranged thrust-bolts 37 are prestressed inside the corresponding bores 38 by resilient rings 39 lying one on top of the other, so that they can be forced into the bores only upon a certain adjustable minimum force being exceeded. The resilient rings 39 are separated from one another by washers 39*a***.

The holddown 35 which with a view to the path which is to be kept clear for the conveyor members (jaws) is provided with two symmetrically arranged recesses 40, exhibits at its bottom face a shaped shoulder 41 projecting downwards, the rounded outer face of which reproduces the upper half of the profile of the groove which is to be formed.

The construction described solves the problem of the integration of the shaping process for the edge-groove into the operating cycle of a multistage press, in the way of which there hitherto stood amongst others the following difficulties:

— The reciprocating drive-motion of the multistage press can by conventional means be applied for the achievement of a peripheral edge-groove with far greater difficulty than the rotary motion of a pressure-roller, — The undercut ( U in FIG. 6) of the profile of the groove does not allow of shaping by operation with exclusively rigid shaping-elements or allows it only by making allowance for complicated constructions, — Achievement of a crease- and undulation-free groove at high stroke-rates is linked with known difficulties.

To eliminating these difficulties it was therefore necessary to find a constructional possibility which allowed the employment of the ram of the multistage press, moving reciprocally and operating at a high stroke-rate, yet guaranteed the achievement of flawless surfaces to the groove.

With the described embodiment of the invention this is achieved by the fact that first of all the profile 30 existing on the cheeks 23 gets driven by the downwards motion of the holddown 35 with the top section of the edge of the can, hard against its projecting formed shoulder and the flange thereby gets preformed. Directly after that the resilient pressure-cushion is squeezed by the pressure-transfer bush 33 radially outwards against the bottom section of the groove and forces this absolutely smoothly against the profile of the cheeks.

During the associated downwards motion of the pressure-transfer bush both the punch 6 and also the holddown must still remain at rest, which is achieved by both of them being resiliently supported with respect to the top-part of the tool.

The device described operates in detail as follows:

The trimmed can-bodies provided with flanges, arriving from the tool of the preceding stage, get fed to the device illustrated by, for example, drawing-tongs and there positioned in such a way that the divided punch 6 can plunge with its bottom part **6*b* into the can body 18 lying on the aforesaid plane of conveyance. At the end of the plunge motion the punch thrusts by its tip 6*c* against the bottom of the can-body and hence carries the can-body with it in the operating direction. In the further course of the downwards motion of the punch 6 its tip with the can body meets the ejector-head 19*c* and pushes this away downwards in front of it against the force of the ejector which is pneumatically actuated via the ejector-rod 19*a*. As already described, the holddown 35 is mechanically coupled with the punch 6 via the tool top-part 1. The consequence of this is that at the start of the motion of the punch 6 the motion of the holddown 35** also commences.

Shortly before, though practically at about the same instant at which through the downwards motion of the punch 6 with the can body 18 and the ejector-head **19*c* the latter encounters with its underside the stop 21 at the bottom of the receiver, the holddown 35 seats with its lower face against the top face of the symmetrically arranged cheeks 23 and the holder-ring 25**.

Hereupon both the cheeks 23 and the holder-ring 25 and also the receiver 17 are moved downwards. In that case the holddown 25 must overcome at least the restoring force of the return-spring 42. The actuation of the holddown 35 is effected by the tool top-part 1 via the spring-stack 39 in combination with the bolts 37. During this downwards motion the cheeks 23 slide at their bevels **23*a* along the conical inner surface of the guide-ring 28 so that simultaneously and forcibly a displacement of the cheeks 23 radially inwards in the direction towards the axis of the punch is produced. The profile 30 of the cheeks hereby forces the edge of the can body radially inwards until the top half of the profile 30 with the edge of the can body runs up against the shaped shoulder 41 of the holddown 35**.

The edge of the can body has hereby been narrowed. At the same time the flange on the can body has been received into a recess **23*b* (FIG. 6) in the cheek 23 and held flat by the holddown 35**, whereby the formation of creases can be avoided.

At the same time with the running of the cheeks 23 up against the shaped shoulder 41 of the holddown the receiver 17 for the can body thrusts against the stop-washer 44. At this instant the top half of the can-edge which is to be shaped is lying firmly clamped between the top half of the profile of the cheeks and the shaped shoulder 41 of the holddown.

Directly afterwards, though practically at the instant of the running of the cheeks 23 up against the shaped shoulder 41 of the holddown and the stopping of the receiver 17 against the stop-washer 44, the punch 6 with the can-body 18 and the ejector head **19*c* encounters the stop 21 on the receiver 17 which is now lying against the stop-washer 44. Since the divided punch 6 is now seated by its bottom-part 6*b*, bulging of the resilient pressure-cushion 32 caught between the punch bottom-part 6*b* and the pressure-transfer bush 33 commences. The bulging is brought about by the relative motion between the seated punch bottom-part 6*b* and the movable pressure-transfer bush 33**.

Figure 4:
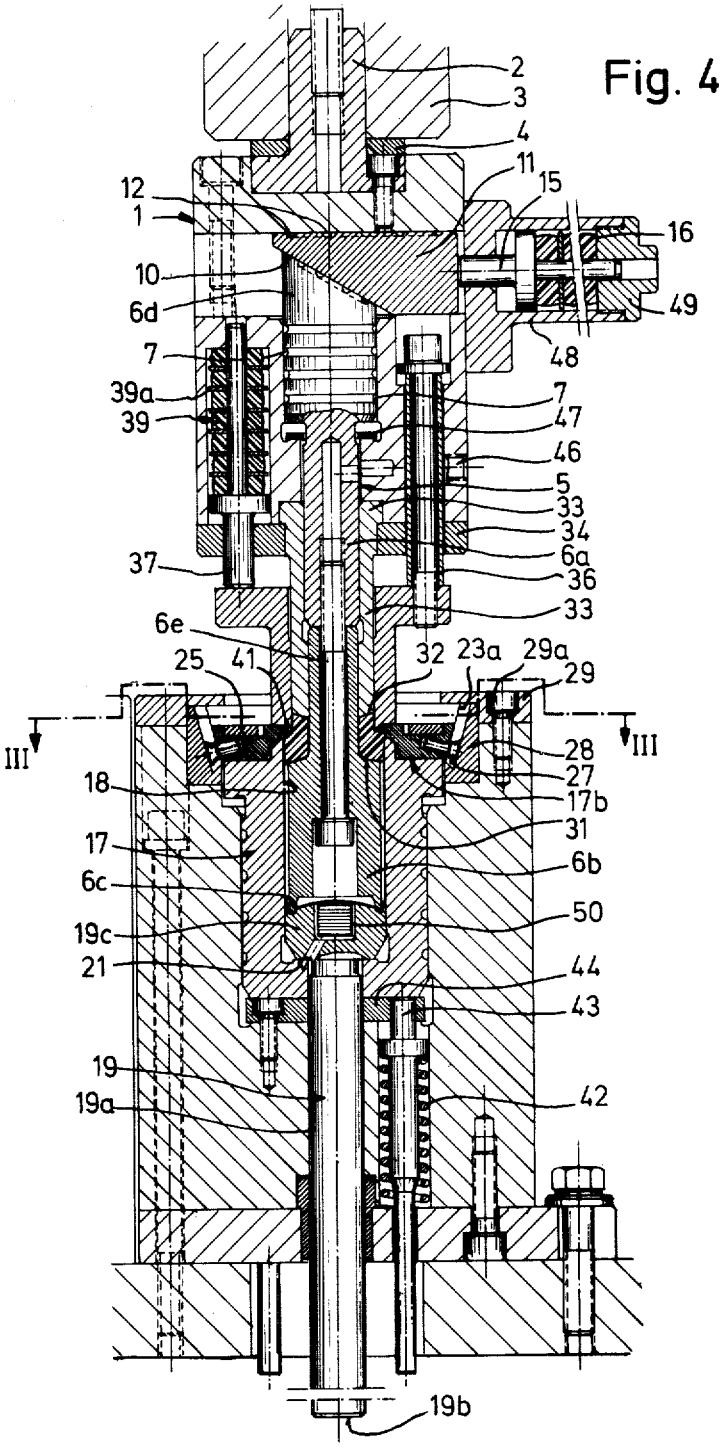
FIG. 4 is a vertical section corresponding with FIG. 3 and shows the device in another operating position.
Figure 5:
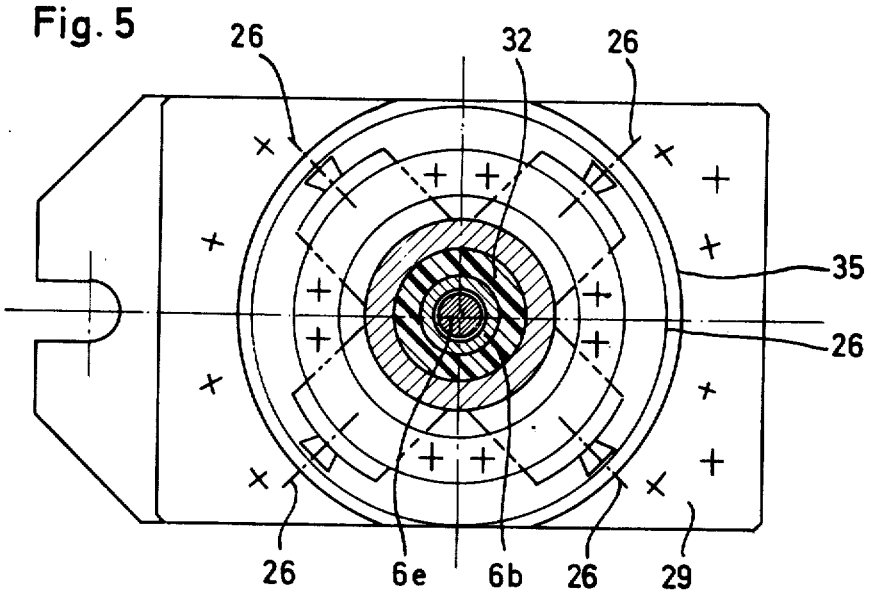
FIG. 5 is a section along the line III—III in FIG. 4.
Figure 6:
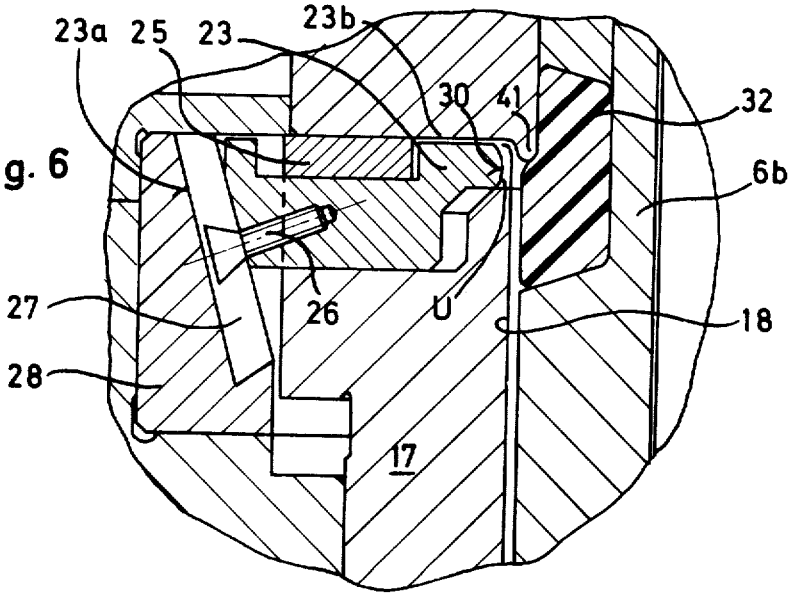
FIG. 6 is an enlarged illustration of one detail of construction.

Support of the punch bottom-part **6*b* so as to be movable in the axial direction enables only with sustained downwards motion of the pressure-transfer bush 33 which is rigidly connected to the tool top-part 1, relative motion between the pressure-transfer bush 33 and the punch bottom-part 6*b* and hence bulging of the resilient pressure-cushion 32. The end position of the axial wedge is set at a relative axial displacement downwards by a spacer-washer 47. A relative axial displacement of the axial wedge 6*d* upwards causes a relative radial displacement of the wedge 11 in the direction towards the spring stack 16. The sum of the forces resulting from the spring elements 16*a* which act via the stud 15 upon the radial wedge 11, must hereby be overcome. The spring stack 16 lies in a spring housing 18 and is retained by the spring-housing cover 49 (FIG. 4**).

The displacement of the resilient pressure-cushion 32 at practically constant volume in the axial direction has the result of displacing it in the radial direction, that is, in the direction towards the wall of the can body. With increasing displacement of the resilient pressure-cushion 32 this will at its periphery touch the wall, preferably the bottom portion of the groove in the can body, and force this can body in its edge zone under the influence of the applied compressive forces by expansion against the bottom half of the profile of the cheeks as well as against the circular cylindrical inner surface of the receiver 17.

After completion of the expansion process the return motion of the tool top-part 1 and the punch top-part **6*a* rigidly connected to it commences. The result of this is release of the stress on the resilient pressure-cushion 32 in the axial direction, whereby at the same time because of constancy of volume radial contraction of it takes place in such a way that the resilient pressure-cushion resumes its original diameter and hence the divided punch 6 as a whole with continuing return motion can withdraw from the can body without thereby touching the shaped edge or even damaging it. In the further course of the return motion of the tool top-part 1 the holddown 35 lifts away from the cheeks 23 and the holder-ring 25, whereupon the return motion of the receiver 17 caused by the restoring force of the return-spring 42 commences towards its original position. At the same time the ejector-head 19*c* actuated by the ejector-rod 19*a* guided in the guide-bush 20, pushes the can body back onto the plane of conveyance. In this position the can body 18 is held by a holder-magnet 50 (FIG. 4) just until the punch 6 has withdrawn from the can body and the drawing-tongs of the feed apparatus have taken over the can body for onwards conveyance. In this case release of the can body from the punch bottom-part can be assisted by compressed air. This is led via the bore 46 (FIG. 4) in the tool top-part 1 and the pierced holding-screw 6*e*** to the tip of the punch.

As has already been confirmed by tests, the device described operates correctly at stroke-rates up to 150 strokes per minute. The edge-groove preformed mechanically by the profile of the cheeks experiences through the expansion by means of the resilient pressure-cushion, smoothing and gauging, creases and undulations in the sheetmetal which may perhaps be present being with certainty pressed smooth.

The embodiment described with the aid of the drawing may be altered by those skilled in the art in many ways. Thus it would, for example, be possible instead of the wedge-drive **6*d*/11 provided for reasons of saving space to employ a bell-crank arrangement. If necessary it would even be possible to arranged the spring stack 16** used for the prestressed support of the punch, directly in the tool top-part, i.e., coaxially with the punch. Nevertheless with a variant of this kind difficulty of access to the spring stack would have to be taken into consideration.

The pressure-cushion 32 preferably consists of an elastically deformable plastics, for example, on a polyurethane base.

The metal hollow bodies to be provided with edge-grooves and flanges supported from these obviously do not unconditionally have to be produced by a draw method but can readily also be produced by means of other methods in the technique of shaping, for example, by extrusion moulding.

The embodiment illustrated in FIGS. 7 to 11 comprises a tool top-part 23 which is fixed by its holding device 2 onto a chuck moving reciprocally. For coarse height-adjustment a washer 4 may be provided.

In the tool top-part is arranged an axially movable wedge **6*d* which is provided with grooves 7 and channels 8 for lubricant and the oblique face 9 of which, inclined at 30° to the horizontal, cooperates with an oblique face 10 of equal inclination on a radial wedge 11. The radial wedge 11 is square in cross-section and is likewise provided with grooves and a channel 13 for lubricant, and is supported to slide in a transverse opening 14 machined out of the tool top-part; it is forced against the oblique face of the axial wedge 6*d* by a stud 15 which is acted upon by a spring stack 15*a***.

The punch constructed in three parts exhibits in this embodiment a top-part 51 (FIGS. 8, 9), a bottom part 52 and a middle part 53. The bottom part 52 and the middle part 53 are designated below in view of their functions, as the punch head 52 and punch-head holder 53.

The punch top-part 51 which is fixed in the bottom end section of the axial wedge **6*d*, is connected with the punch-head holder 53 by a bolt 54. Onto the bottom part of the punch-head holder 53 is fixed by means of a holding-bolt 55 an auxiliary stripper 56. A spiral spring 57 bearing against the auxiliary stripper 56 keeps the punch head 52** which is formed as a cylindrical bush, continually under prestress in the direction of the punch top-part.

Figure 7:
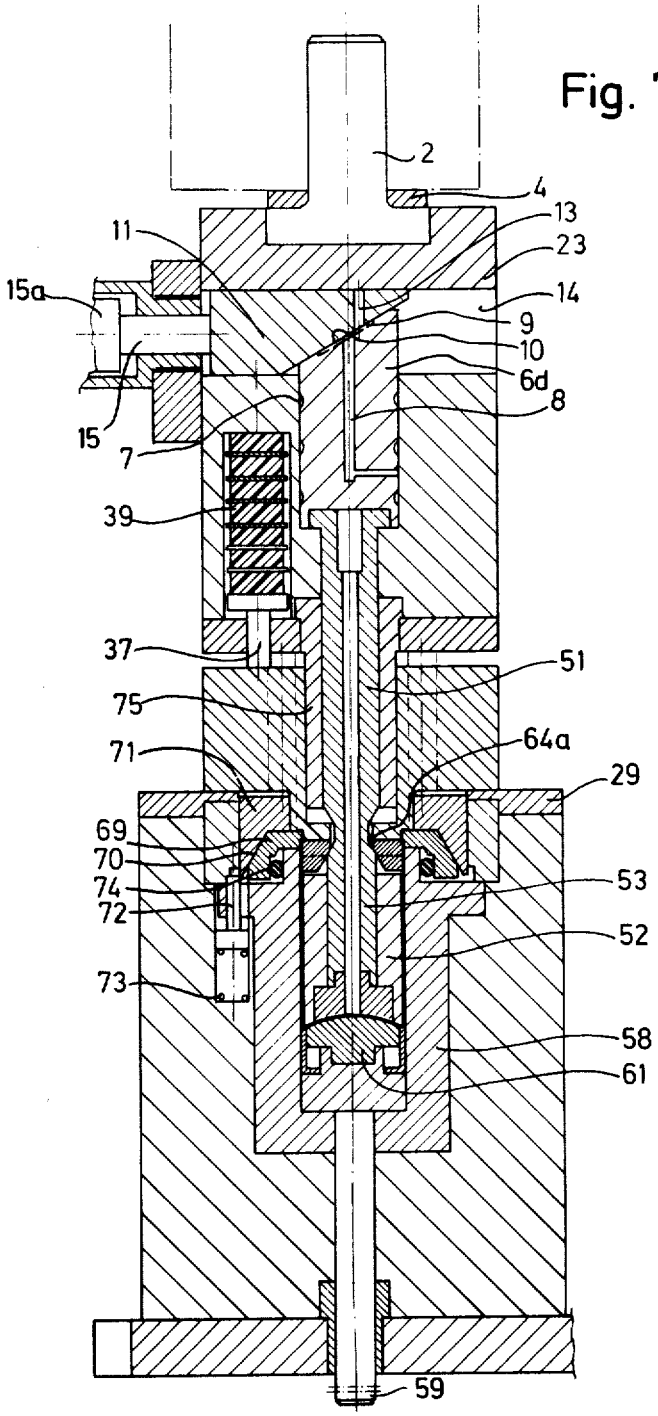
FIG. 7 shows a vertical section of such a device, in slightly simplified form.
Figure 9:
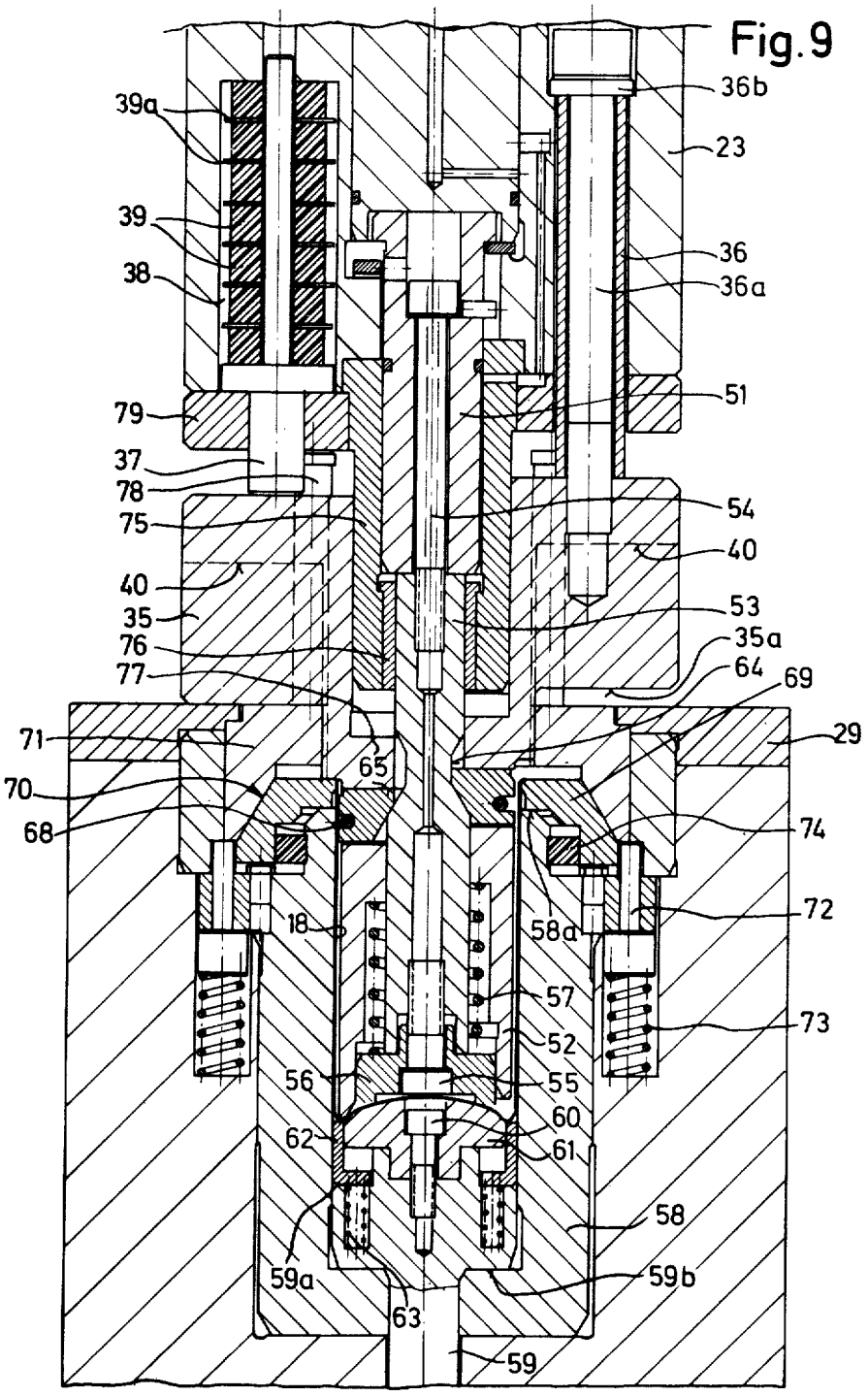
FIG. 9 illustrates two further phases in the production of the edge groove, the die parts being shown in the righthand half of FIG. 9 shortly before transfer into their operating position which in the lefthand half of this Figure has been reached.

In accordance with FIGS. 7 and 9 the punch head 52 projects into the bore **58*a* in a receiver 58 and an ejector-rod 59 supported resiliently (for example, on an air cushion) projects through the bottom of the receiver, an ejector head 61 being fixed to its top end by means of a bolt 60. An annular auxiliary ejector 62 of L-shaped cross-section is under pre-stress from a spiral spring 63**.

The punch-head holder 53 is provided approximately in its central zone with a recess 64 the bottom annular bevel face **64*a* of which is in particular of functional significance. As shown especially also in FIG. 11, four transfer-elements 65 offset by 90° from one another are supported to slide against this bevel face 64*a*, so that these transfer-elements 65 in a downwards motion at the same time have to move radially outwards. Each transfer-element 65 then slides in the gap between two adjoining shaped slides 66 which can slide outwards on a horizontal guideway until under the pressure of the transfer-elements 65 they have reached the position shown in FIG. 11**.

The shaped slides 66 in consideration of their function advantageously have the shape of segments of a circle the chord of which exhibits two sections forming an obtuse angle, so that the transfer-elements 65 can each slide between two adjoining shaped slides 66 and thereby force these radially outwards (FIG. 11).

Both the shaped slides 66 and also the transfer-elements 65 carry at their peripheral edge the inside profile of the corrugation or edge-groove to be applied to the blank 18. The shaped slides 66 and the transfer-elements 65 as a whole are prestressed by a rubber ring 68 arranged in an annular groove 67, which when no external forces are acting tries to pull them into the original position as in FIG. 2.

Figure 8:
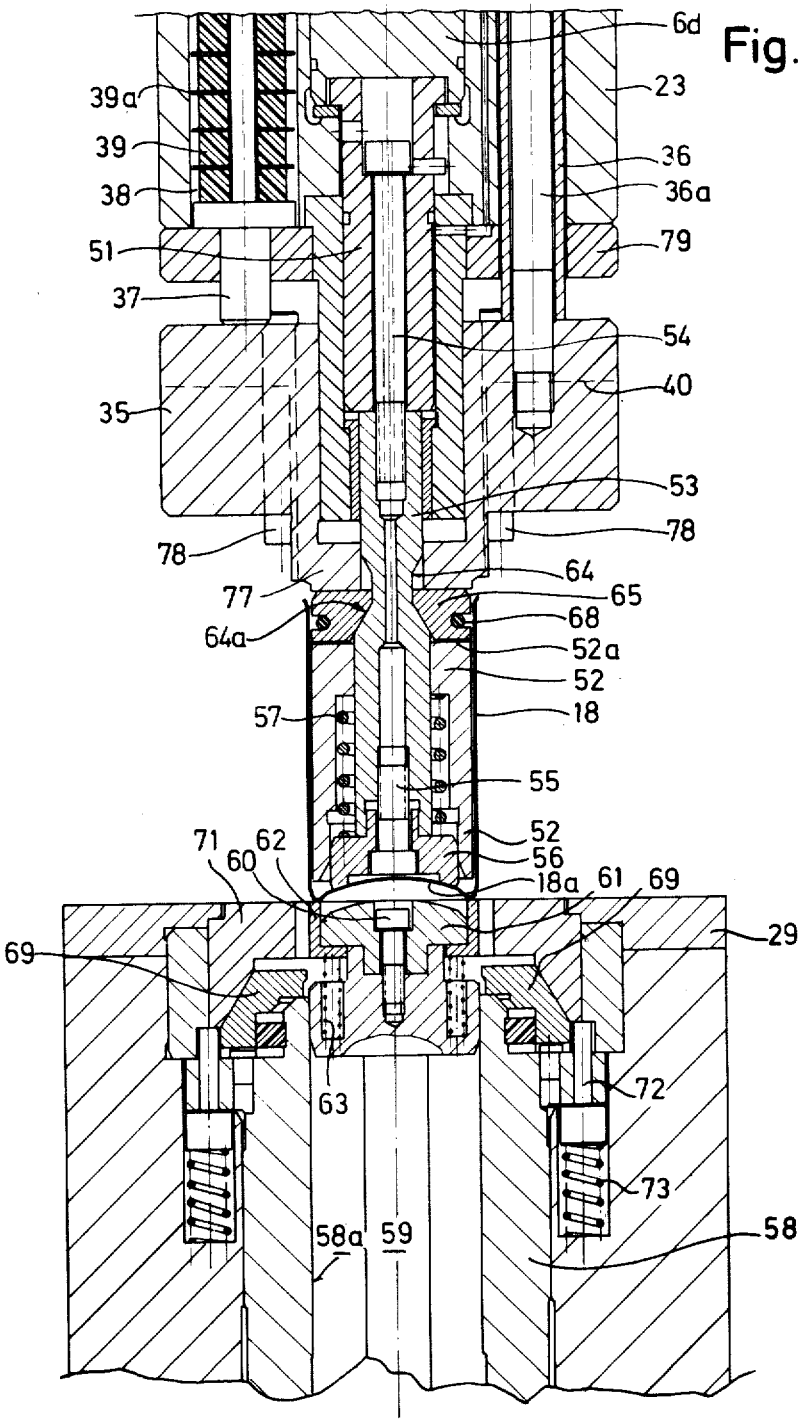
FIG. 8 shows the device shortly before the entry of the punch head into the blind bore in the receiver.

At the top part of the receiver 58 there are in addition arranged in an annular recess altogether 16 pressure-cheeks 69 which on their faces next the axis of the punch bear the outside profile of the corrugation or edge-groove and are provided on their opposite sides with a bevel 70. A pressure-ring 71 arranged above the pressure-cheeks 69 exhibits at its bottom part an annular bevel face matching the bevel 69 and resting against it. The pressure-ring is so supported that it can be displaced within a certain stroke parallel with the axis of the punch. It lies continually under resilient upwards-directed prestress from recall-bolts 72 which are under the influence of return-springs 73. The movement of the pressure-ring 71 upwards is limited by a coverplate 29 (FIG. 8).

From the foregoing description it is already evident that the pressure-cheeks 69 upon downwards motion of the pressure-ring 71 get forced in the radial direction towards the axis of the punch. They then are pressing with their bottom inner faces against a recall-ring 74 which gets compressed and forces the pressure-cheeks 69 back outwards after their release by the pressure-ring 71.

In the light of their function the transfer-elements 65 and the shaped slides 66 can therefore also be designated as die bottom-parts.

At the periphery of the punch top-part 51 is arranged a guidebush 75 in the bottom section of which lies a small guidebush 76 for the punch-head holder 53. Against the outer face of the guidebush 75 there is here too arranged a holddown 35 the movement of which in the tool top-part is limited in the axial direction by means of spacer-sleeves 36 and clampscrews **36*a* with washers 36*b* and which in addition is acted upon by prestressed thrust-bolts 37. The symmetrically arranged thrust-bolts 37 are prestressed inside the corresponding bores 38 by resilient rings 39 lying one on top of the other, so that they can be forced into the bores only upon a certain adjustable minimum force being exceeded. The resilient rings 39 are separated from one another by washers 39*a***.

The holddown 35 which with a view to the path which is to be kept clear for the conveyor members (jaws) is provided with two symmetrically arranged recesses 40, exhibits at its bottom face an extension 77 projecting downwards, the bottom outer edge of which reproduced the upper half of the profile of the groove which is to be formed.

In the holddown 35 a number of pressure-bolts 78 are supported to slide freely in the axial direction with axial clearance, so that these pressure-bolts can transfer forces from the bottom closure-plate 79 of the tool top-part onto the pressure-ring 71.

The device described operates as follows:

During the forward motion of the punch 51/52/53 the auxiliary stripper 56 touches the bottom 18*a* of the blank 18 and pushes it away in front of it until the bottom of the blank encounters the annular auxiliary ejector 62 and pushes it away in front of it up to the stop against the annular endface 59*a* of the ejector 59. At practically the same instant the auxiliary stripper 56 with the bottom of the blank runs up against the ejector head 61 and hence brings about the forward motion of the ejector 59 in the bore of the receiver 58.

The downwards motion of the auxiliary stripper 56 fixed to the punch-head holder comes to a stop as soon as the ejector 59 abuts with its annular flange-face 59*b* against the bottom of the bore.

As already described, the whole punch 51/52/53 is supported resiliently in the axial direction by the wedge-drive 6*d*/11 (FIG. 7). Consequently, after the forward motion of the punch-head holder 53 has come to a stop, the tool top-part 23 can continue to move forwards relative to the punch and also to the blank 18 which is to be grooved.

When the punch via the ejector 59 runs up against the bottom of the blind bore in the receiver 58 the holddown extension 77 has already seated. The transfer-elements 65 and shaped slides 66 lying against the end and annular guide surfaces and which as a whole are designated below as die bottom-parts, are hereby brought against the axially acting force of the prestressed return springs 57 out of the readiness position in accordance with FIG. 9, righthand half, into the operating position in accordance with FIG. 9, lefthand half. The die bottom-parts 65 and 66 arranged in pairs opposite one another then slide on the horizontal guide-surface 52*a* and against the inclined guide-surface 64*a* on the punch-head holder 53. Consequently the transfer-elements 65 are moved in the axial direction forwards and in the radial direction outwards and thereby take the shaped slides 66 with them. This proceeds until the transfer elements 65 and with them the shaped slides 66 impinge with their cylindrical barrel surfaces against the inside of the wall of the blank and force this hard against the wall of the bore of the receiver 58. In this position, thus in the operating position of the die bottom-parts 65 and 66, these are clamped firmly between the die top-part 35, the punch-head holder 53 and the wall of the blank or respectively the receiver 58. At the same time as the die bottom-parts 65/66 the die top-part 77 too is lying in the operating position in such a way that the divided die consisting of the parts 65, 66 and 77 hereby forms a closed mould. The closing-forces of the divided die originate from the aforesaid axially arranged spring stack 39 which is additionally poststressed by the relative motion which has occurred, and are at the conclusion of the closing process limited by the die top-part 35 running with its end face 35*a* next the tool bottom-part up against the outer face of the coverplate 29. At practically the same instant the thrust-bolts 78 run with their end faces against the outer end face of the pressure-ring 71 and move this in the axial direction forwards against the axially-acting forces of the recall-bolts 72 upon which act the prestressed return-springs 73.

By virtue of the wedge-shaped construction of the pressure-ring 71 the pressure-cheeks 69 arranged in pairs and lying opposite one another are hereby by their oblique guidefaces 70 and against the forces of the return-spring 74 pushed inwards in the radial direction. The pressure-cheeks 69 then lie up against and around the wall of the blank and form the edge-groove in its edge zone by continuing movement.

The resilient recall of the transfer elements 65 and shaped slides 66 can in many cases not be guaranteed by a simple rubber ring 68. In that case there is preferably employed the construction in accordance with FIG. 12 in which the force of resilient recall of a number of resilient recall members 80 is transferred via levers 81 to the shaped slides 66. By appropriate choice of the lever arms or arrangement of the lever pivot 82 the force of recall can be further varied.

As again FIG. 13 shows, recall of the transfer elements 65 and shaped slides 66 does not absolutely have to be effected by means of a resilient member. In the variant illustrated in FIG. 13 there are arranged in the punch head 53 a number of rigid recall-members 83 distributed uniformly round the perimeter, the top sections of which engage in correspondingly shaped shoulders 84 in the shaped slides 66. The parts 65 and 66 are guided between the sliding surfaces 86 and 87, as is also the case in the embodiment already described (cf. FIG. 10).

Figure 14:
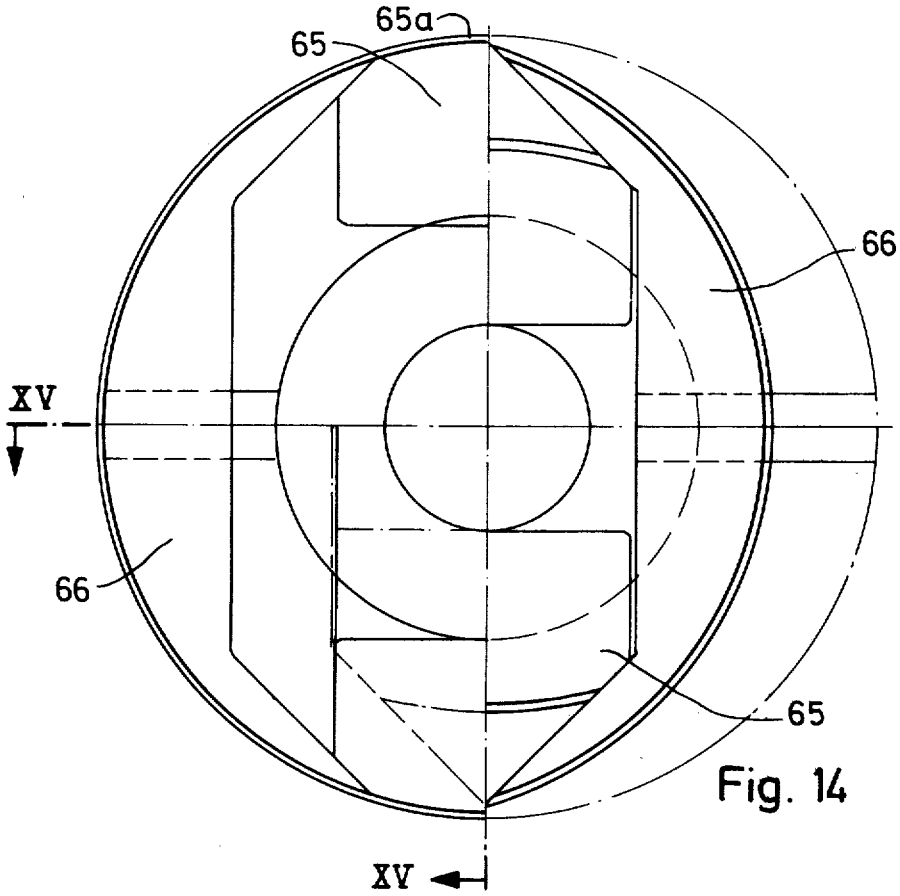
FIGS. 14 and 15 show the profiling of the bottom parts of the die if merely two transfer-elements and two shaped slides are provided.
Figure 15:
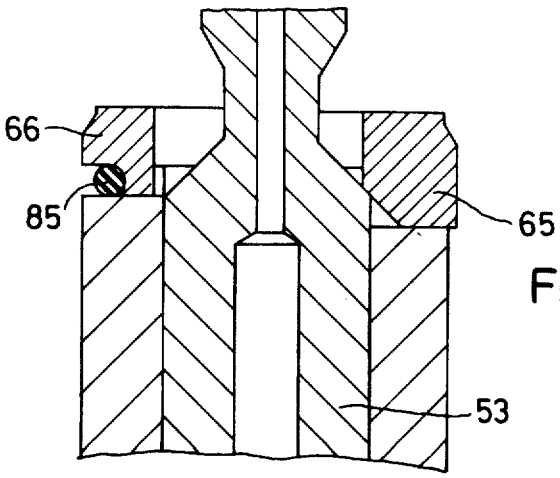

Although the embodiments as FIG. 11 shows four transfer-elements 65 and four shaped slides 66, variants are quite possible with a greater or smaller number of subdivisions of the die. In the case of an embodiment having two transfer-elements 65 and two shaped slides 66 these parts could be formed, e.g., in accordance with FIGS. 14 and 15. Here too each transfer-element 65 can be slid in between the two adjoining shaped slides 66 and the shaped slide in that case moves outwards, the ensuing gap being bridged across by the end faces 65*a* of the transfer-element itself. A resilient recall-ring 85 may be arranged in an annular groove.

I claim:

1. A device for forming a smooth, crease- and undulation-free, inwardly convex flange-bearing edge-groove or -corrugation onto the open end of a metal hollow body, and particularly a metal container, formed in a press, comprising a tool top-part arranged to be periodically reciprocally driven, a housing, at least one resiliently prestressed deflector member having a bore with a mouth at one end thereof, a punch in said housing and supported by said tool top-part and arranged to move axially towards said deflector member, a receiver having a bore with a mouth at one end thereof for receiving said hollow body, at least two cheeks arranged in the zone of the mouth of the receiver bore, the working surfaces of which face the axis of the punch and bear the profile of the groove to be formed in the edge of the hollow body and which are slidable in the radial direction on a sliding surface on the face of the receiver, a pressure-transfer member arranged in said housing, at least one shaping-part arranged at the periphery of the punch between a part of said punch and said pressure-transfer member, and a holddown supported slidingly above the bottom part of the tool and arranged coaxially with the punch and which bears by its top face via prestressed forced-transfer members against the tool top-part, whereby the cheeks and the shaping part during the working stroke of the punch are pressed from the outside and inside respectively against the top edge of the hollow body and shape the edge-groove or -corrugation, the pressure-transfer member performing a relative movement with respect to the punch during the pressing against the cheeks and the shaping part.

2. A device according to claim 1, wherein the receiver includes an ejector and is supported coaxially with the punch to be able to slide axially against the prestress of at least one recall-member, the cheeks being anchored in the receiver and on their sides remote from the axis of the punch being guided along inclined guideways in such a way that any axial motion of the receiver also compels radial displacement of the cheeks, and the shaping-part being a resiliently deformable pressure-cushion which is arranged at the periphery of the punch between a shoulder on the punch and said pressure-transfer member fixed rigidly in the punch housing, the force of prestress of the deflector-member acting on the punch as well as those of the force-transfer members of the holddown being respectively at least equal to the sum of the forces acting on the ejector and the receiver so that during a downward movement of the punch housing the holddown encounters at least one of the receiver and the cheeks and with simultaneous axial displacement of the receiver presses the cheeks radially inwards against the container-edge to be shaped, whereupon the pressure-transfer member encounters the resilient pressure-cushion and presses this at least against the bottom section of the profile of the considered and partially preformed groove.

3. A device according to claim 2, wherein the prestressed deflector-member is, for the purpose of achieving a spacesaving arrangement, in the form of a wedge supported in the tool top-part to be able to slide transversely to the axis of the punch, and the oblique face of which rests against a correspondingly formed oblique face on the punch and the slide of which opposite to the oblique face is supported by a support-member which is under prestress.

4. A device according to claim 2, wherein the receiver is constructed as a substantially circular cylindrical bush onto the top face, formed as a sliding surface, of which the cheeks are bolted by means of a holder-ring in such a way that they can slide in the radial direction between two end positions, the inclined guideways being provided with dovetail grooves in which are guided correspondingly shaped slider-members of the cheeks.

5. A device according to claim 2, wherein the holddown exhibits on its face next to the pressure-cushion a shaped shoulder corresponding with the container edge-groove to be shaped and which in the final position of this shaping stage extends substantially up to the central plane of the cheek-profile which serves to form the edge-groove.

6. A device according to claim 2, wherein the pressure-cushion is profiled, in particular a stepped ring consisting of a resilient mass.

7. A device according to claim 2, wherein the force-transfer members arranged between the tool top-part and the holddown are formed as bolts which project into bores in the punch housing and carry inside these bores each a row of resilient rings arranged one on top of the other on the shank of the bolt.

8. A device according to claim 2, further comprising a support-member in the form of a stud supported to slide in the end walls of a bush and the section of which lying inside the bush carries a row of resilient rings arranged coaxially on the shank of the stud.

9. A device according to claim 1, wherein the punch head is fixed onto a punch head holder projecting coaxially into it, which exhibits just above the punch head a guide-face inclined to the axis of the punch against which at least three transfer-elements are guided, the radially-outwards-pointing end-sections of which cooperate with at least three shaped slides which are supported to slide, and the transfer-elements and shaped slides carry on their faces the internal profile of the edge-groove or -corrugation to be shaped.

10. A device according to claim 9, wherein in the surrounding zone of the shaped slides outside the receiver bore is arranged in a ring a number of pressure-cheeks which on the one hand rest slidingly against a horizontal annular face on the receiver and on the other hand exhibit each on the side of it remote from the axis of the punch an oblique face which cooperates with an oblique face of equal slope on a pressure-ring which can be actuated by the tool top-part via a number of peripherally distributed bolts supported to slide with an axial clearance.

11. A device according to claim 10, wherein the shaped slides are formed in the shape of segments of a circle the chord of which exhibits two sections forming an obtuse angle in such a way that the transfer-elements can respectively slide between two adjoining shaped slides and thereby force these radially outwards.

12. A device according to claim 9, wherein the said holddown exhibits adjacent the die an annular projection the end face of which is adapted to the profile of the groove which is to be formed.

13. A device according to claim 10, wherein a resilient recall-ring is arranged in the radial surrounded zone of the pressure-cheeks.

14. A device according to claim 9, wherein the transfer-elements and shaped slides are prestressed in the direction of the axis of the punch by a resilient member.

15. A device according to claim 9, wherein for recall of the transfer-elements and shaped slides there is arranged rigidly fixed in the punch-head holder a number plurality of strikers the end sections of which project into corresponding recesses in the shaped slides.

16. A device according to claim 9, wherein recall of the transfer-elements and shaped slides is effected by individual resilient recall-members associated with each of the shaped slides, the resilient restoring force of which is transferred to the shaped slides by levers.

* * * * *